US006185879B1

(12) United States Patent
Engwall

(10) Patent No.: US 6,185,879 B1
(45) Date of Patent: Feb. 13, 2001

(54) HOUSE BUILDING MODULE AND METHOD RELATED THERETO

(76) Inventor: Sten Engwall, Charlottenbergs Gard, 5-195 92, Märsta (SE)

( * ) Notice: Under 35 U.S.C. 154(b), the term of this patent shall be extended for 0 days.

(21) Appl. No.: 09/284,587

(22) PCT Filed: Oct. 16, 1997

(86) PCT No.: PCT/SE97/01737

§ 371 Date: Apr. 15, 1999

§ 102(e) Date: Apr. 15, 1999

(87) PCT Pub. No.: WO98/16704

PCT Pub. Date: Apr. 23, 1998

(30) Foreign Application Priority Data

Oct. 17, 1996 (SE) ..... 9603830-2

(51) Int. Cl.[7] ..... E04C 2/00

(52) U.S. Cl. ..... 52/125.4; 52/143; 52/309.7; 52/309.16; 52/405.3; 52/794.1

(58) Field of Search ..... 52/125.4, 143, 52/309.7, 309.8, 309.9, 309.12, 309.15, 309.16, 282.1, 293.1, 592.1, 586.1, 405.3, 794.1, 745.13, 745.1, 745.2, 745.19

(56) References Cited

U.S. PATENT DOCUMENTS

| | | | | |
|---|---|---|---|---|
| 2,200,636 | | 5/1940 | Palmer . | |
| 3,106,227 | * | 10/1963 | Crowley | 52/309.12 X |
| 3,696,567 | * | 10/1972 | Villaneu | 52/125.4 X |
| 4,569,167 | * | 2/1986 | Staples | 52/293.1 X |
| 4,901,491 | * | 2/1990 | Phillips | 52/293.1 X |
| 4,982,548 | | 1/1991 | Abbey . | |
| 5,311,712 | * | 5/1994 | Accousti | 52/293.1 X |
| 5,313,753 | * | 5/1994 | Sanger | 52/405.3 X |
| 5,335,473 | * | 8/1994 | Chase | 52/745.19 X |
| 5,524,400 | * | 6/1996 | Schmechel | 52/309.7 X |
| 5,526,629 | * | 6/1996 | Cavaness | 52/745.19 |
| 5,588,272 | * | 12/1996 | Haponski | 52/125.4 X |
| 5,758,463 | * | 6/1998 | Mancini, Jr. | 52/309.7 X |

FOREIGN PATENT DOCUMENTS

| | | |
|---|---|---|
| 1 709 405 | 9/1973 | (DE) . |
| 3 237 697 A1 | 4/1984 | (DE) . |
| 364 541 | 2/1974 | (SE) . |
| 436 372 | 6/1984 | (SE) . |
| 501 558 | 3/1995 | (SE) . |

* cited by examiner

*Primary Examiner*—Beth A. Stephan
*Assistant Examiner*—Brian E. Glessner
(74) *Attorney, Agent, or Firm*—Banner & Witcoff

(57) ABSTRACT

The present invention relates to a house building module for module systems used in house building and methods in connection herewith. According to the invention, the module includes cellular plastic and U-sections of metal fitted into the cellular plastic as well as at least one concrete reinforcement extending in the longitudinal direction of the module. A house building module according to the invention can be comprised of a wall portion with integrated foundation portion (70). For casting the concrete reinforcement a method is applied in which the module per se constitutes a casting mold.

3 Claims, 5 Drawing Sheets

1
2
3
4
5
6
7
8
9
IV
IV

Fig 12
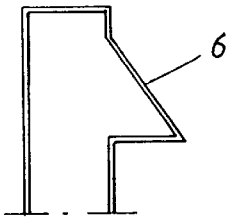
Fig 13
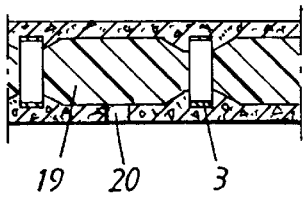
Fig 14
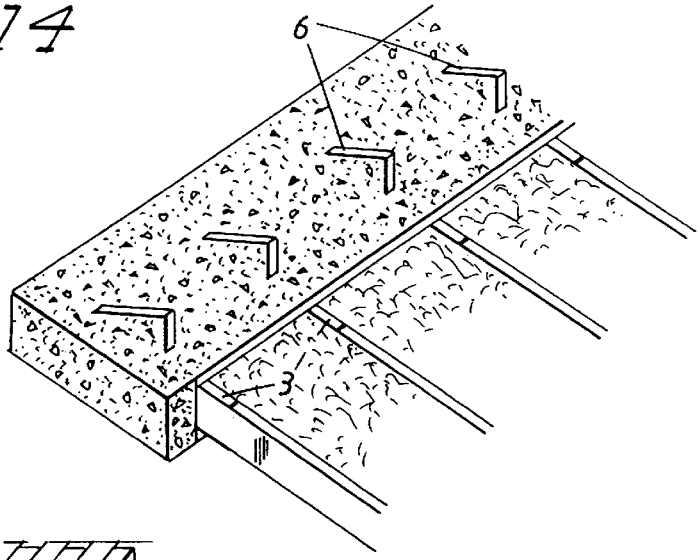
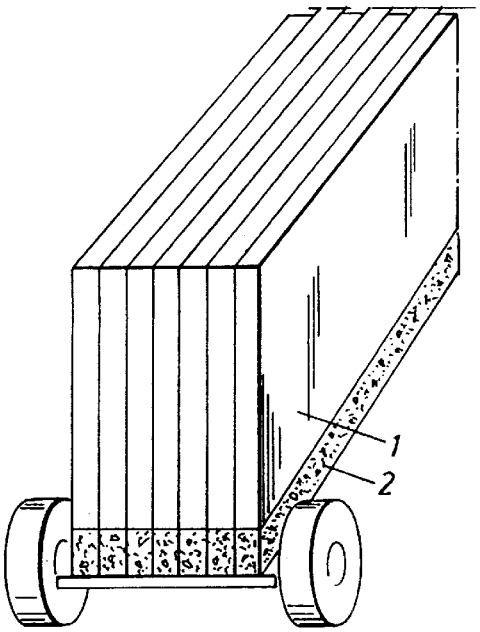
Fig 15

HOUSE BUILDING MODULE AND METHOD RELATED THERETO

BACKGROUND AND SUMMARY OF INVENTION

Houses are not manufactured according to industrial principles, i.e. in long series and with integrated solutions, and are therefore neither good nor inexpensive but, at best, only good.

It is true that small houses of prefabricated construction are manufactured but this is done with very limited sizes of the climate shell. For instance, walls can only with difficulty be made longer than up to the double length as compared to the wall height, i.e. 4,8 m. In the case of greater lengths, measures have to be taken to compensate the wall's own stability in the longitudinal direction.

The rest of the climate shell today is constructed as cross segments of the longitudinal direction of the house and in any case not with stability being possible in two directions.

The present invention in a first aspect relates to a house building module having a wall portion and a foundation portion and to a method of manufacturing such a module as well as to a method in manufacturing a house using such a module.

Traditional house building technique is usually based on construction in situ. This is often complicated and costly. In certain respects, the house building technique has been aimed at utilizing the rationalization advantages provided by the use of prefabricated elements, thus cutting down on building time and cost. Said prefabricated elements, however, generally only involved separate units of the building, such as wall elements.

An important aspect when building a house is the connection of its walls with the foundation. Also in this case, prefabrication principles could be applied to a greater extent. Certain attempts to that effect have been made. Other important aspects when applying the module principle within the house building technique is the connection of the walls to roof portions as well as how to connect the modules to each other, and their connection to other elements of the house, such as structural beams.

EP-0 016 478 discloses a prefabricated unit including a wall portion as well as a base portion. The construction is heavy and unwieldy in that it constitutes a cast-solid concrete element, and in several ways is difficult to use in rational construction.

Further, from SE-415 989 there is previously known a base element in the shape of an inverted T. The base element, however, does not include the wall itself but only constitutes its base portion. It therefore has the disadvantages related to traditional building technique. In the magazine Byggforskning No. 3/96, an article on pages 3–5 describes a new way of thinking as regards the use of modules within the house building technique. Among others, the possibilities of forming walls consisting of polystyrene and sheet profiles joined to the foundation walls by casting are discussed. However, in said article there is no further information as to how this could be implemented in the form of a prefabricated module.

The object of the present invention is to solve the problem of providing a practically applicable modular system for building houses which is favourable from the economic point of view and, more particularly, to solve the problems associated with the connection of house walls with the foundation of the house in an optimal manner in the form of a module while avoiding the disadvantages of prior attempts within the art.

According to the invention the above problems are solved by a house building module and methods of manufacturing such a module presented with special features and special measures.

Through the invented module system possibilities are provided of rationally using prefabricated elements in house building owing to the system including modules which integrate wall portions with foundation portions.

Through the invented house building module where the wall portion is integratedly connected to the foundation portion, any thermal bridge between the wall and the foundation is eliminated in that there is uninterrupted insulation between them, and owing to the use of several different materials, it is possible to reduce the weight of the module, thereby facilitating transport and enabling the choice of material for the wall portion and the foundation portion respectively to be optimized for the respective function. Since it is possible to keep the weight low, larger element surfaces can be produced. Further, it can be done in a rational way. This, in turn, speeds up the building process. In addition, the load-bearing structure can be made weaker.

Preferably, the foundation portion is given a higher specific weight than the wall portion, which is an important aspect as regards reducing the total weight and facilitating transport.

The three materials, in another preferred embodiment, are metal, cellular plastic and concrete, which materials when suitably combined in the module are appropriate for achieving the low weight and the rational manufacture and handling.

The measures disclosed enable the house building module according to the invention with wall and foundation portion to be manufactured quickly and an appropriate combination of materials for the various parts as well as an effective interconnection thereof to be achieved.

The method disclosed utilizes the advantages provided by the house building module according to the invention in the production of houses. Thus, the module is particularly suited to be prefabricated. Thanks to the combination of materials, which makes it possible to have a wall portion with lower density than the foundation portion, there is provided appropriate transportation of the modules in that they can be in an upright position.

The claims dependent on the respective independent claims define advantageous embodiments of the invention.

Through a combination of materials and an interconnection solution previously not employed, the present invention makes it possible to industrially manufacture and to transport units which make better use of both the volume and the weight capacity of the transport vehicles and which simplify the building process.

The material comprises cellular plastic, concrete and sheet profiles. The sheet profiles have a flange which fits into grooves in the cellular plastic. The flanges are thereby prevented from breaking since the cellular plastic can absorb high dynamic pressures.

The U-sections on either side of the cellular plastic do not reach each other's flanges and therefore there will be no so called thermal bridge in the climate shell elements. If required, the sheet profiles are interconnected by a steel band (used within the packaging industry) the sectional area of which in the form of a thermal bridge is completely negligible (5 $mm^2$ per wall square meter)

The concrete adheres very well to cellular plastic and to advantage may therefore be joined to the cellular plastic by casting in the longitudinal direction of the elements while the U-sections extending transversely to the elements will be embedded and will thus provide stability in this direction.

No mould has to be produced when casting since the materials included in the construction provide the very mould. This is of great economic and practical importance in the manufacture, especially in the manufacture on the construction site.

BRIEF DESCRIPTION OF THE DRAWINGS

The present invention will now be described in more detail by means of preferred embodiments with reference to the appended drawings in which

FIG. 12 is a detail of a foundation-wall-module according to the invention, FIG. 13 is a partial section through a foundation-wall-module according to the invention, FIG. 14 is a perspective view of the finished foundation-wall-module, FIG. 15 is a perspective view of foundation-wall-modules during transport, and FIG. 16 is a perspective view of a detail of a preferred embodiment of a module according to the invention.

DETAILED DESCRIPTION OF THE PREFERRED EMBODIMENT(S)

Figure 1:
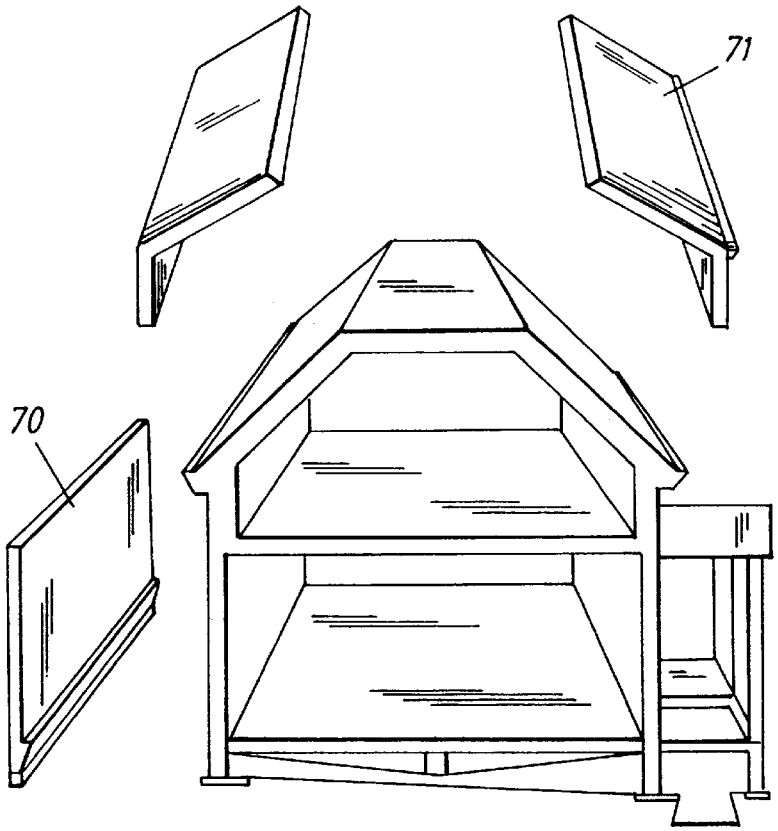
FIG. 1 is an exploded view of a house with the module according to the invention.
Figure 1B:
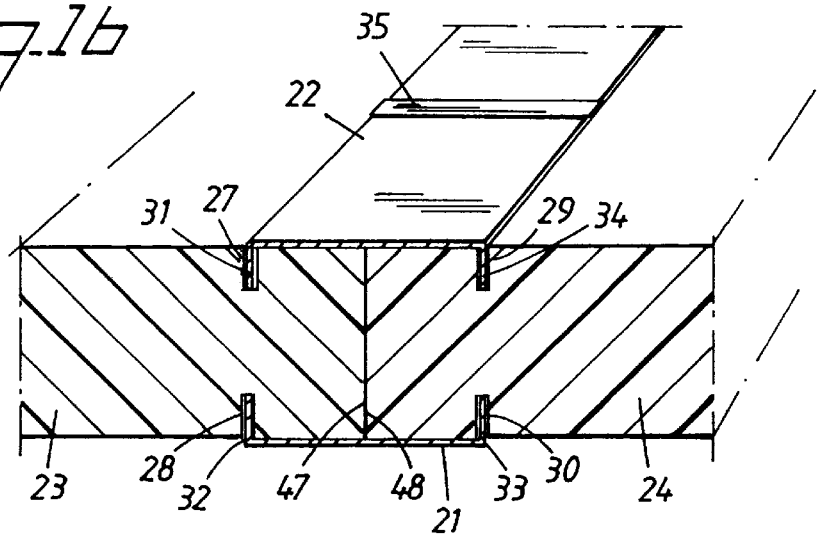

In FIG. 1 there is depicted a house built of prefabricated house building modules according to the invention, with some modules also being shown separately, where the module 70 is a foundation-wall-module of the above-described kind.

Figures 2, 3, 4:
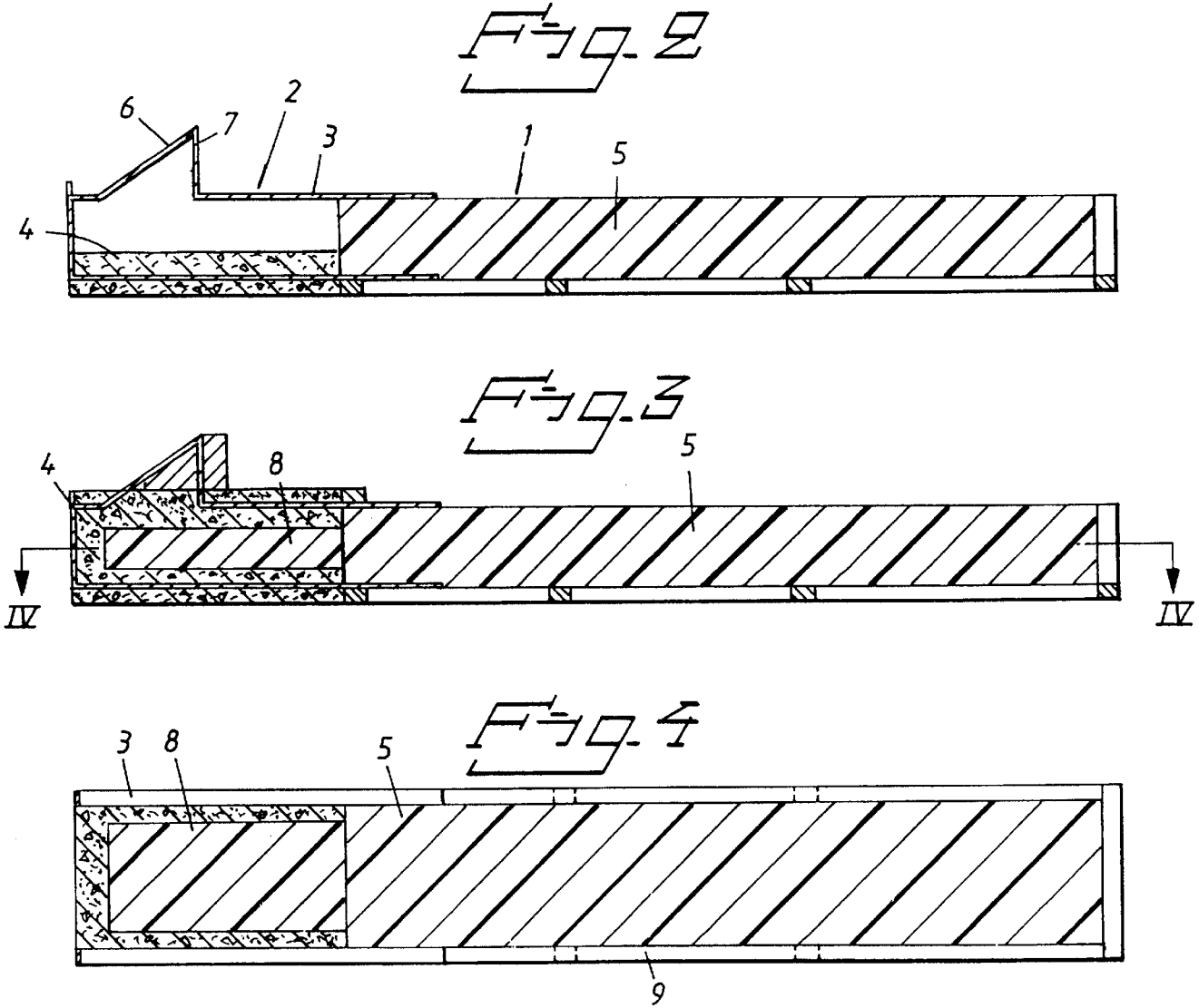
FIG. 2 is a longitudinal section through a foundation-wall-module according to a first embodiment of the module.
FIG. 3 is a longitudinal section as in FIG. 2 of a second embodiment of the invention.
FIG. 4 is a partial section along the line IV—IV in FIG. 3.

The house building module of FIG. 2 is shown in the lying position, i.e. with the wall portion 1 in the horizontal position and the foundation portion 2 farthest to the left in the Figure. Flat steel sections 3 interconnect the wall portion 1 and the foundation portion 2 and provide armouring. The foundation portion 2 mainly consists of concrete 4 and the wall portion 1 consists of cellular plastic 5. The flat steel section 3, when the building module is in position, has a protrusion 6 facing the interior of the house, one side 7 of which is horizontal when the module is in position and provides a beam support as a bedding for the floor beams.

In the embodiment according to FIG. 3, part of the foundation portion 2, more particularly the core portion 8 thereof, is also made of cellular plastic. In other respects, this embodiment is identical with the one shown in FIG. 1. Part of the module in FIG. 3 is shown in a longitudinal section in FIG. 4, from which may be seen how the flat steel sections are connected with posts 9 on the wall portion, between which posts 9 the cellular plastic is disposed.

In the modules shown in FIGS. 2–4, the foundation portion 2 will weigh around 3–500 kg per running meter and the wall portion around 40–80 kg per running meter.

Figure 5:
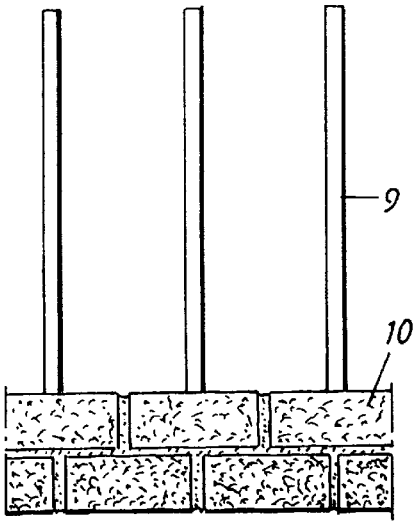
FIG. 5 is a front view of the construction of a foundation-wall-module according to a third embodiment.
Figure 6:
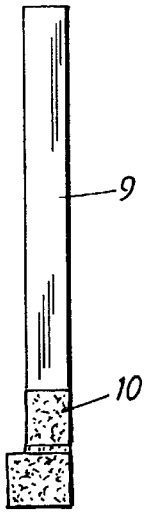
FIG. 6 is a side view of the module of FIG. 5.

FIGS. 5 and 6 show how the module can be formed as a standing supporting framework of posts 9 which are integrated in smaller units 10, such as LECA-stones of standard lengths. This is done by direct embedment, or by special cramps, however, in that case only in the upper layer.

Figure 7:
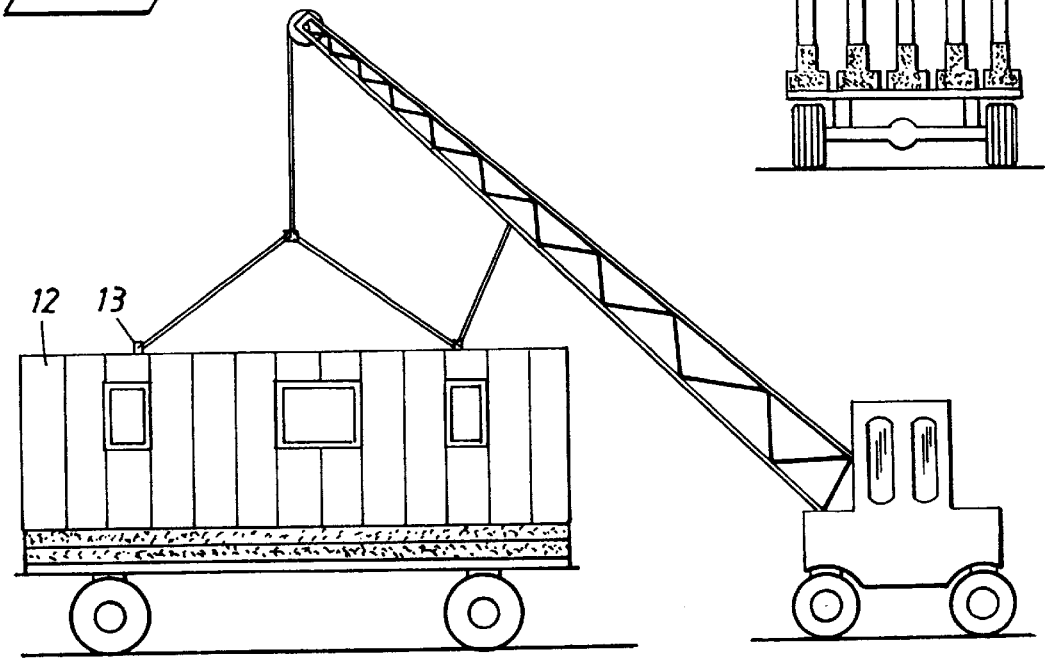
FIG. 7 is a side view of foundation-wall-modules during transport.

In FIG. 7 there is shown how the house building modules can be transported in an upright position. The module 12 shown comprises a full facade length and at the top has extensions 13 of supporting parts, which can be used for lifting as indicated in the Figure, and which may be cut off after mounting.

Figure 8:
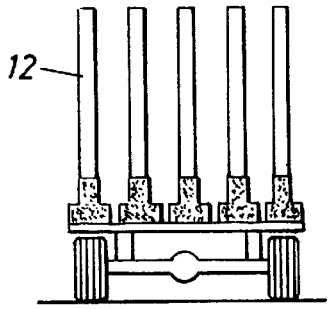
FIG. 8 is an end view of what is shown in FIG. 7.

From FIG. 8 may be seen how a plurality of modules 12 of this kind during transport are placed in an upright position beside each other, their foundation portions resting on the platform. Thanks to the weight distribution in the modules, with a large part of the weight concentrated to the foundation portion there is provided a low centre of gravity and hence favourable transport conditions.

Figure 9:
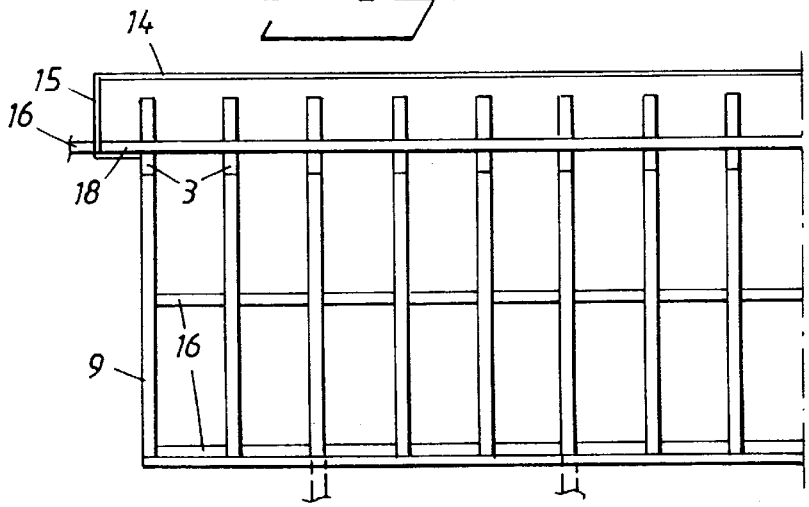
FIGS. 9–11 illustrate a stage of production, in a plan view from above, a side view and a perspective view, respectively.
Figure 10:
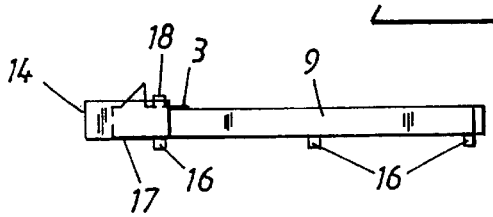
Figure 11:
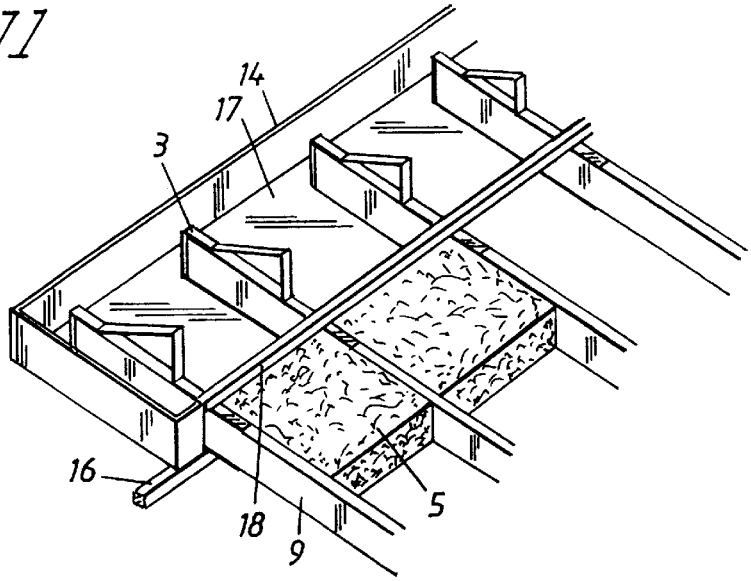

In FIGS. 9–11 there is illustrated how a house building module according to the invention can be manufactured in an advantageous way. Manufacturing takes place with the wall portion of the module in the horizontal position, for instance, lying on the floor of the production premises, and in FIG. 9 this is shown from above. A plate 14 is positioned on the floor to provide part of the mould in which the foundation portion is cast. The longitudinal extent of the plate corresponds to the length of the module and at each end is provided with an angular section 15. A plurality of posts 9 are located transversely to the longitudinal extension of the plate 14 and such that one end of each post extends as far as a short distance from the plate 14. The posts may suitably have a dimension 50×150 mm and in FIG. 9 are upended. The distance between the symmetrical axes of the posts is typically 60 cm, or 120 cm. The posts are laid out on three battens 16 parallel to the plate 14, the battens having a dimension of 50×50 mm, one batten being disposed at each end and one in the centre of the posts. When laid out, each post 9 is provided with a flat steel section 3 at the end facing the plate 14. The flat steel section 3 is bent in a way evident from FIG. 12 such that the protrusion 6 with the support surface 7 is formed to provide the floor beam support. The flat iron section has sufficient strength to be able to withstand lifting of the entire module with a lifting device at the opposite end of the wall portion. The position of the section 3 on the post is adapted such that the floor beam support 6 will be at the correct height. It may be to advantage to alternatively form the posts as hollow rectangular metal profiles.

In FIG. 10 there is shown from the side a post 9 provided with flat steel sections 3 extending into the space partly defined by the plate 14 which constitutes a casting mould for the foundation portion. The Figure also shows that the plate 14 has an angled back portion 17 extending up to the nearest batten 16. Opposite the batten 16 adjacent to the foundation portion, an overlying batten 18 is located on the upper side of the posts and these two battens will also form part of the casting mould.

As shown in FIG. 11, the space between the posts 9 is filled with blocks of cellular plastic 5. On the part of the cellular plastic which is nearest to the foundation portion a thin surface layer is applied, which extends around 20–30 cm from the batten 16, 18 at the foundation portion.

Thereafter, casting of the foundation portion is carried out. This can be done by filling the mould completely with concrete so that a substantially uniform foundation portion is provided, corresponding to the embodiment shown in FIG. 3. When manufacturing a module according to the embodiment shown in FIG. 2, the mould is filled with concrete corresponding to a height of 5 cm only. Sheets of cellular plastic are then placed between the flat steel sections to provide insulation, and concrete is filled on the upper side. When casting the foundation portion, the elements making up its shape also constitute components in the finished module, meaning that no special mould for casting is required.

FIG. 13 shows the appearance of the foundation portion in a sectional view along the longitudinal direction of the mould and with the cellular plastic present therein indicated at 19.

In FIG. 14 there is depicted the finished module with the protrusions 6 of the flat steel sections projecting past the concrete for forming floor beam supports.

A module manufactured in the above described way allows compact transportation of a plurality of modules placed upright close to each other, as shown in FIG. 15. To facilitate this, recesses were located in the foundation portion on the side opposite the floor beam support during manufacture. Such a recess 20 is illustrated in FIG. 13. The width and the depth of the recess 20 are adapted for the protrusion 6 of an adjacent module to project thereinto. In this way, the modules are anchored during transport so that, in addition, the risk of displacement of the load will be reduced.

Alternatively, the floor beam support shown in the drawings may be attached to the module afterwards. The connecting flat steel section is then formed without the recess 6 shown.

In a preferred embodiment of the invention, the posts are formed as metal profiles to which sheets of cellular plastic are attached. Such a construction is illustrated in FIG. 16. Each post consists of two shallow U-sections 21 and 22 of sheet metal. These are disposed opposite each other along side edge surfaces 47, 48 of two sheets of cellular plastic 23, 24, which abut against each other. In each sheet of cellular plastic there is disposed a cut 27, 28, 29, 30 on either side and at a distance from the side 20 edge surfaces 47, 48, which cut is adapted such as for the U-sections to be pressed in towards their legs 31–34 in the grooves, holding the sheets 23, 24 together. Suitably, the two U-sections may be held together at some locations by a steel band 35, although this is not necessary per se.

Since the module is formed with such posts of pairs of U-sections of sheet metal, these can be extended at least on one side of the sheets of cellular plastic, so that they will extend into the concrete thereby providing means for connection with the foundation portion. These will then replace the flat steel sections 3 used in the previously described embodiments.

What is claimed is:

1. A house building module comprising a wall portion of full wall height having a cellular plastic part and a concrete part, both parts extending along substantially an entire length of the module in a horizontal direction thereof, the cellular plastic part forming an upper portion of the module and the upper portion of the module being substantially free of concrete, the concrete part forming a lower portion of the module, the cellular plastic part having a vertical extension that is much larger than a vertical extension of the concrete part, so that the vertical extension of the concrete part is a small fraction of the total module height, the module further including vertical profile posts extending through the cellular plastic part and through the concrete part, so that the cellular plastic part and concrete part make up a prefabricated integrated module having a wall portion and a foundation portion.

2. A house building module according to claim 1 in which the extent of the module in the longitudinal direction is at least twice its vertical extent.

3. A house building module according to claim 1 in which at least one of the said metal profile posts (9) is provided with a lifting device at its end facing away from the foundation portion.

* * * * *